US009179206B2

(12) United States Patent
Tai et al.

(10) Patent No.: US 9,179,206 B2
(45) Date of Patent: Nov. 3, 2015

(54) SOUND BOX STRUCTURE

(71) Applicant: Acer Inc., New Taipei (TW)

(72) Inventors: Kuei-Ting Tai, New Taipei (TW); Jia-Ren Chang, New Taipei (TW); Po-Jen Tu, New Taipei (TW)

(73) Assignee: Acer Inc., New Taipei (TW)

( * ) Notice: Subject to any disclaimer, the term of this patent is extended or adjusted under 35 U.S.C. 154(b) by 0 days.

(21) Appl. No.: 14/151,872

(22) Filed: Jan. 10, 2014

(65) Prior Publication Data

US 2015/0055817 A1 Feb. 26, 2015

(30) Foreign Application Priority Data

Aug. 23, 2013 (TW) ..... 102130372 A

(51) Int. Cl.
*H04R 25/00* (2006.01)
*H04R 1/02* (2006.01)

(52) U.S. Cl.
CPC ..... *H04R 1/025* (2013.01)

(58) Field of Classification Search
CPC .. H04R 1/2842; H04R 1/2834; H04R 1/2849; H04R 2499/11; H04R 1/225; H04R 1/2811; H04R 17/00; H04R 1/02; H04R 1/227; H04R 1/2803; H04R 1/2819; H04R 1/2857; H04R 2307/025; H04R 5/02; H04R 7/04; H04R 7/16; H04R 9/022; H04R 1/025
USPC ..... 381/346, 347, 350, 353, 354, 345, 334; 379/433.02
See application file for complete search history.

(56) References Cited

U.S. PATENT DOCUMENTS

| | | | | | |
|---|---|---|---|---|---|
| 4,875,546 | A * | 10/1989 | Krnan | ..... | 181/160 |
| 5,092,424 | A * | 3/1992 | Schreiber et al. | ..... | 181/145 |
| 6,144,738 | A * | 11/2000 | Hawker et al. | ..... | 379/433.02 |
| 6,169,811 | B1 * | 1/2001 | Croft, III | ..... | 381/186 |
| 6,389,146 | B1 * | 5/2002 | Croft, III | ..... | 381/345 |
| 6,522,759 | B1 * | 2/2003 | Mori | ..... | 381/150 |
| 6,704,426 | B2 * | 3/2004 | Croft, III | ..... | 381/351 |
| 7,103,193 | B2 * | 9/2006 | Croft, III | ..... | 381/345 |
| 8,107,662 | B2 * | 1/2012 | Parker | ..... | 381/345 |
| 8,755,553 | B2 * | 6/2014 | Slotte | ..... | 381/353 |
| 2012/0269373 | A1 * | 10/2012 | Slotte | ..... | 381/353 |

* cited by examiner

*Primary Examiner* — Davetta W Goins
*Assistant Examiner* — Phylesha Dabney
(74) *Attorney, Agent, or Firm* — Alan D. Kamrath; Kamrath IP Lawfirm, P.A.

(57) ABSTRACT

A sound box structure includes a sound box, a speaker, and a gas absorption element. The sound box includes a sound box space. A first hole is formed on one plane of the sound box, and a second hole is formed on another plane of the sound box. The speaker is mounted on the first hole. The gas absorption element is mounted on the second hole.

20 Claims, 2 Drawing Sheets

SOUND BOX STRUCTURE

BACKGROUND OF THE INVENTION

1. Field of the Invention

The present invention relates to a sound box structure. More particularly, the present invention relates to a sound box structure capable of immediately adjusting the effective volume of a sound box.

2. Description of the Related Art

A sound box structure generally comprises a casing and a speaker installed in the casing. The speaker is used for transforming an electrical signal into structural vibration to generate sound. The sound quality of the sound box structure is not only related to the speaker itself but also extremely related to the casing of the speaker. Generally speaking, a sound chamber in the sound box structure with a greater volume will reduce the damping effect of the air inside the sound box structure on the sound produced by the speaker. In such manner, the lowest resonant frequency of the speaker can be lower, thereby achieving a better low frequency response effect and thus improving the sound quality of the sound box structure.

As mentioned above, the low frequency response of the speaker is reliant on the internal volume of the box structure. In order to have better low frequency extension, a larger speaker has to be used. However, in a relatively small electronic device, such as a mobile phone, the size of the overall device has certain limitations. Therefore the effective volume of the speaker sound box is reduced, which accordingly raises the low frequency resonant frequency of the speaker sound box. The increase in the low frequency resonant frequency of the speaker sound box will degrade the low-pitched sound performance of the speaker and increase the distortion of the speaker, thereby influencing the sound quality of the mobile phone.

Therefore, there is a need to provide a sound box structure to mitigate and/or obviate the aforementioned problems.

SUMMARY OF THE INVENTION

It is an object of the present invention to provide a sound box structure that is capable of extending the low frequency response effect of a speaker.

To achieve the abovementioned object, according to one embodiment of the present invention, the sound box structure of the present invention comprises a sound box, a speaker, and a gas absorption element. The sound box includes a sound box space. A first hole is formed on one plane of the sound box, and a second hole is formed on another plane of the sound box. The speaker is mounted on the first hole. The gas absorption element is mounted on the second hole and is used for absorbing or releasing gas in the sound box space when the speaker is driven in order to change the volume of the sound box space.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENTS

Figure 1A:
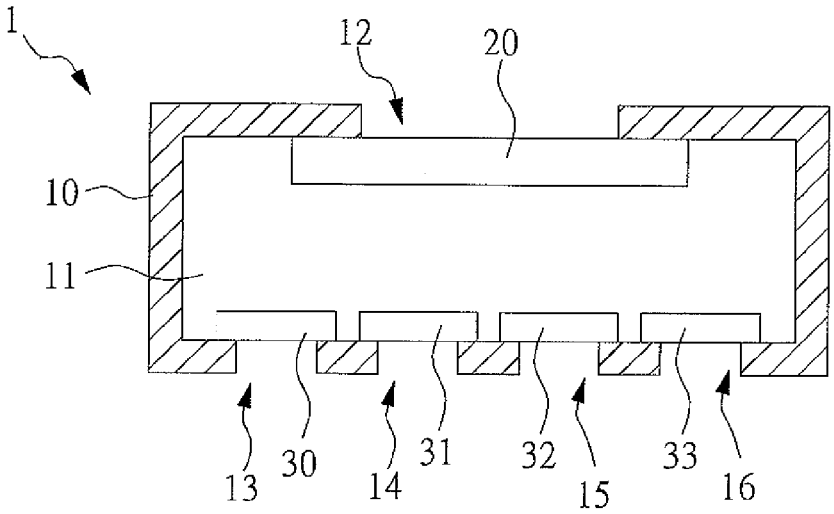
FIGS. 1A, 1B and 1C illustrate structural drawings of a sound box structure according to a first embodiment of the present invention.
Figure 1B:
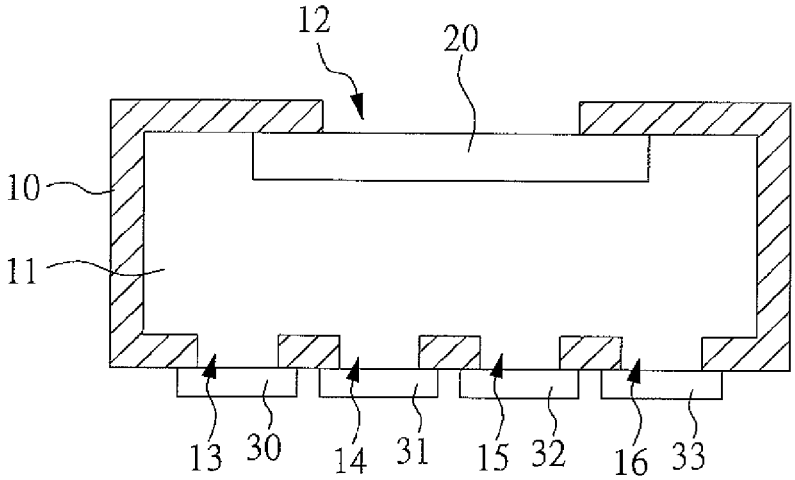
Figure 1C:
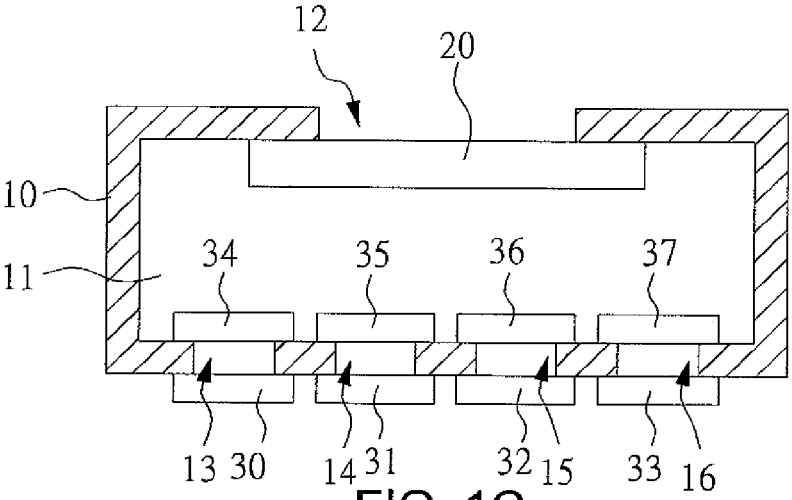

Please refer to FIGS. 1A, 1B and 1C, which illustrate structural drawings of a sound box structure according to a first embodiment of the present invention. As shown in FIG. 1A, according to one embodiment of the present invention, the sound box structure 1 of the present invention comprises a sound box 10, a speaker 20, and gas absorption elements 30, 31, 32 and 33. The sound box 10 is in the form of a box structure, and a sound box space 11 is formed therein. A first hole 12 is formed on one plane of the sound box 10, and four second holes 13, 14, 15 and 16 are formed on another plane of the sound box 10. The speaker 20 is mounted on the first hole 12, such that the speaker 20 can produce sound or trigger resonance via the first hole 12. The four gas absorption elements 30, 31, 32 and 33 are respectively mounted on the four second holes 13, 14, 15 and 16, and the second holes 13, 14, 15 and 16 can be used for guiding sound. When the speaker 20 is driven, the gas absorption elements 30, 31, 32 and 33 can absorb or release gas in the sound box space 11 in order to change the volume of the sound box space 11. According to such design, the low frequency response effect of the speaker 20 can be enhanced, thereby extending the low frequency response of the speaker 20. The sound box structure 1 of the present invention can be applied in a portable device of a relatively small size, such as but not limited to a mobile phone, a personal digital assistant (PDA), or a handheld game console.

According to one embodiment of the present invention, the speaker 20 is mounted on the first hole 12 at the internal side of the sound box space 11. However, please note that the scope of the present invention is not limited to the above description. The speaker 20 can also be mounted on the first hole 12 at the external side of the sound box space 11. The four second holes 13, 14, 15 and 16 are all in the form of a round hole type, and the diameter of the four second holes 13, 14, 15 and 16 is substantially 1 mm, without limiting the scope of the present invention. Furthermore, as shown in FIG. 1A, the four second holes 13, 14, 15 and 16 are all formed on one plane opposite to the plane on which the first hole 12 is formed. However, please note that the scope of the present invention is not limited to the above description. For example, the four second holes 13, 14, 15 and 16 can be distributed on other planes of the sound box 10.

According to one embodiment of the present invention, as shown in FIG. 1A, the four gas absorption elements 30, 31, 32 and 33 are respectively mounted on the four second holes 13, 14, 15 and 16. When the speaker 20 performs repeatedly bi-directional movement in the sound box space 11, the gas absorption elements 30, 31, 32 and 33 can relatively absorb or release air molecules in response to pressure variations generated accordingly. Through air molecule flows, the pressure variation of the sound box space 11 can be continuously reduced, such that the effective volume of the sound box space 11 can greatly exceed the actual volume. Therefore, the low frequency extension can exceed the actual size of the box structure. As a result, the cone movement of the speaker can be as free as if it were disposed in a large box structure even if it is disposed in a small box structure such as a mobile phone or a PDA.

According to one embodiment of the present invention, as shown in FIG. 1A, the four gas absorption elements 30, 31, 32 and 33 are respectively mounted on the four second holes 13, 14, 15 and 16 at the internal side of the sound box space 11. However, please note that the scope of the present invention is not limited to the above description. As shown in FIG. 1B, the four gas absorption elements 30, 31, 32 and 33 can also be mounted on the four second holes 13, 14, 15 and 16 at the external side of the sound box space 11. Moreover, according to another embodiment of the present invention, as shown in FIG. 1 C, eight gas absorption elements 30, 31, 32, 33, 34, 35, 36 and 37 can be respectively mounted on the four second holes 13, 14, 15 and 16 at both the internal side and the external side of the sound box space 11.

According to one embodiment of the present invention, the gas absorption elements 30, 31, 32, 33, 34, 35, 36 and 37 all comprise a low-density material. The low-density material is selected from, but not limited to, one of foam or sound absorption foam. For example, the gas absorption elements 30, 31, 32, 33, 34, 35, 36 and 37 can also be active carbon.

Figure 2A:
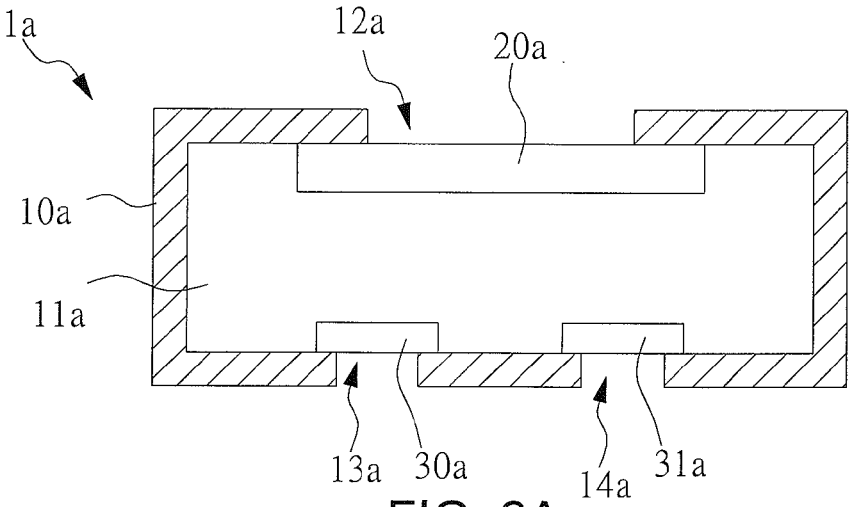
FIGS. 2A, 2B and 2C illustrate structural drawings of the sound box structure according to a second embodiment of the present invention.
Figure 2B:
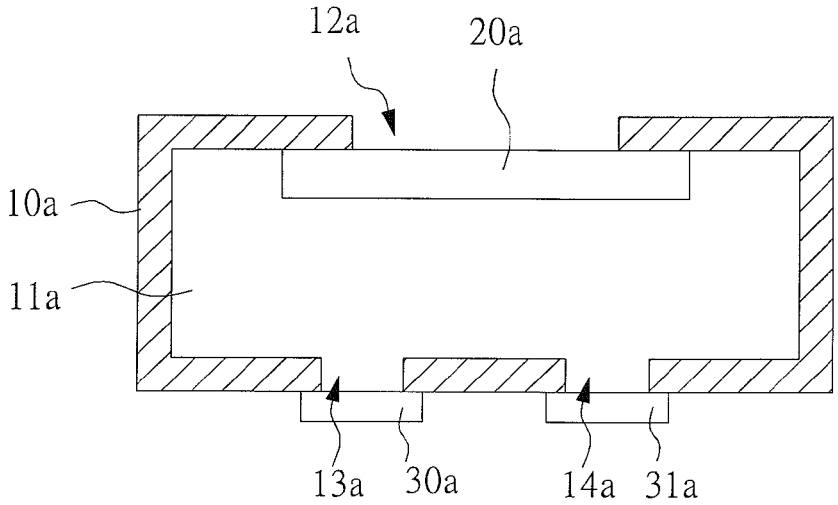
Figure 2C:
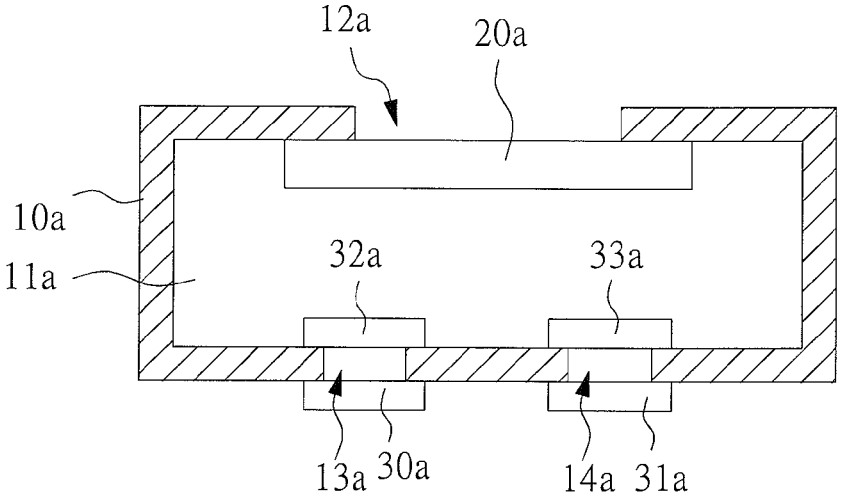

Next, please refer to FIGS. 2A, 2B and 2C, which illustrate structural drawings of the sound box structure according to a second embodiment of the present invention. As shown in FIG. 2A, according to one embodiment of the present invention, the sound box structure la of the present invention similarly comprises a sound box 10*a*, a speaker 20*a*, and gas absorption elements 30*a* and 31*a*. The sound box 10*a* includes a sound box space 11*a*. The major difference between the second embodiment and the first embodiment is the number of the second holes. A first hole 12*a* is formed on one plane of the sound box 10*a*, and two second holes 13*a* and 14*a* are formed on another plane of the sound box 10*a*. The speaker 20*a* is mounted on the first hole 12*a*.

As shown in FIG. 2A, according to one embodiment of the present invention, the two second holes 13*a* and 14*a* are both in the form of a round hole type, and the diameter of the two second holes 13*a* and 14*a* is substantially 2 mm, without limiting the scope of the present invention. The two gas absorption elements 30*a* and 31*a* are respectively mounted on the two second holes 13*a* and 14*a*. When the speaker 20*a* is driven, the gas absorption elements 30*a* and 31*a* can absorb or release gas in the sound box space 11*a* in order to change the volume of the sound box space 11*a*.

As shown in FIG. 2A, according to one embodiment, the two gas absorption elements 30*a* and 31*a* are respectively mounted on the two second holes 13*a* and 14*a* at the internal side of the sound box space 11*a*. However, please note the scope of the present invention is not limited to the above description. As shown in FIG. 2B, the two gas absorption elements 30*a* and 31*a* can also be mounted on the two second holes 13*a* and 14*a* at the external side of the sound box space 11*a*. Moreover, according to another embodiment of the present invention, as shown in FIG. 2C, four gas absorption elements 30*a*, 31*a*, 32*a* and 33*a* can be respectively mounted on the two second holes 13a and 14a at both the internal side and the external side of the sound box space 11*a*.

Although the present invention has been explained in relation to its preferred embodiments, it is to be understood that many other possible modifications and variations can be made without departing from the spirit and scope of the invention as hereinafter claimed.

What is claimed is:

1. A sound box structure comprising:

a sound box including a sound box space, wherein a first hole is formed on one plane of the sound box, wherein at least one second hole is formed on another plane of the sound box;

a speaker mounted on the first hole; and at least one gas absorption element respectively mounted on the at least one second hole, used for absorbing or releasing gas in the sound box space when the speaker is driven in order to change the volume of the sound box space, wherein the at least one gas absorption element is active carbon.

2. The sound box structure as claimed in claim 1, wherein the at least one second hole is a round hole type.

3. The sound box structure as claimed in claim 2, wherein a diameter of the at least one second hole is substantially 1 mm.

4. The sound box structure as claimed in claim 3, wherein a number of the at least one second holes is four.

5. The sound box structure as claimed in claim 2, wherein a diameter of the at least one second hole is substantially 2 mm.

6. The sound box structure as claimed in claim 5, wherein a number of the at least one second holes is two.

7. The sound box structure as claimed in claim 2, wherein a thickness of the at least one gas absorption element is substantially 2 mm.

8. A sound box structure comprising:

a sound box including a sound box space, wherein a first hole is formed on one plane of the sound box, wherein at least one second hole is formed on another plane of the sound box;

a speaker mounted on the first hole; and at least one gas absorption element respectively mounted on the at least one second hole, used for absorbing or releasing gas in the sound box space when the speaker is driven in order to change the volume of the sound box space, wherein the at least one second hole is a round hole type, wherein a diameter of the at least one second hole is substantially 1 mm.

9. The sound box structure as claimed in claim 8, wherein the at least one gas absorption element comprises a low-density material.

10. The sound box structure as claimed in claim 9, wherein the low-density material is selected from one of foam or sound absorption foam.

11. The sound box structure as claimed in claim 8, wherein a number of the at least one second holes is four.

12. A sound box structure comprising:

a sound box including a sound box space, wherein a first hole is formed on one plane of the sound box, wherein at least one second hole is formed on another plane of the sound box;

a speaker mounted on the first hole; and at least one gas absorption element respectively mounted on the at least one second hole, used for absorbing or releasing gas in the sound box space when the speaker is driven in order to change the volume of the sound box space, wherein the at least one second hole is a round hole type, wherein a diameter of the at least one second hole is substantially 2 mm.

13. The sound box structure as claimed in claim 12, wherein a number of the at least one second holes is two.

14. The sound box structure as claimed in claim 12, wherein the at least one gas absorption element comprises a low-density material.

15. The sound box structure as claimed in claim 14, wherein the low-density material is selected from one of foam or sound absorption foam.

16. A sound box structure comprising:

a sound box including a sound box space, wherein a first hole is formed on one plane of the sound box, wherein at least one second hole is formed on another plane of the sound box;

a speaker mounted on the first hole; and at least one gas absorption element respectively mounted on the at least one second hole, used for absorbing or releasing gas in the sound box space when the speaker is driven in order to change the volume of the sound box space, wherein a thickness of the at least one gas absorption element is substantially 2 mm.

17. The sound box structure as claimed in claim 16, wherein the at least one gas absorption element comprises a low-density material.

18. The sound box structure as claimed in claim 17, wherein the low-density material is selected from one of foam or sound absorption foam.

19. The sound box structure as claimed in claim 16, wherein the at least one second hole is a round hole type.

20. The sound box structure as claimed in claim 19, wherein a diameter of the at least one second hole is substantially 1 mm.

* * * * *